US012553289B2

(12) United States Patent
Themig et al.

(10) Patent No.: US 12,553,289 B2
(45) Date of Patent: Feb. 17, 2026

(54) MULTILATERAL TECHNOLOGIES FOR WELLBORES

(71) Applicant: ROKK ENERGY TECHNOLOGIES INC., Calgary (CA)

(72) Inventors: Daniel J. Themig, Calgary (CA); Jody R. McGlothen, Brighton, CO (US); Jim Fehr, Calgary (CA)

(73) Assignee: ROKK ENERGY TECHNOLOGIES INC., Calgary (CA)

( * ) Notice: Subject to any disclaimer, the term of this patent is extended or adjusted under 35 U.S.C. 154(b) by 0 days.

(21) Appl. No.: 18/408,146

(22) Filed: Jan. 9, 2024

(65) Prior Publication Data

US 2024/0229561 A1 Jul. 11, 2024

Related U.S. Application Data

(60) Provisional application No. 63/438,067, filed on Jan. 10, 2023.

(51) Int. Cl.

| | |
|---|---|
| ***E21B 47/098*** | (2012.01) |
| ***E21B 7/04*** | (2006.01) |
| ***E21B 7/06*** | (2006.01) |
| ***E21B 41/00*** | (2006.01) |
| ***E21B 43/10*** | (2006.01) |

(52) U.S. Cl.

CPC ..... *E21B 7/046* (2013.01); *E21B 7/061* (2013.01); *E21B 41/0035* (2013.01); *E21B 43/10* (2013.01); *E21B 47/098* (2020.05)

(58) Field of Classification Search

CPC ..... E21B 7/046; E21B 47/098; E21B 7/061; E21B 41/0035; E21B 43/10

See application file for complete search history.

(56) References Cited

U.S. PATENT DOCUMENTS

| | | | | |
|---|---|---|---|---|
| 2,397,070 | A * | 3/1946 | Zublin | E21B 7/061 166/50 |
| 5,415,238 | A * | 5/1995 | Nice | E21B 41/0035 166/381 |
| 6,012,526 | A * | 1/2000 | Jennings | E21B 41/0035 166/55.7 |
| 6,244,340 | B1 | 6/2001 | McGlothen et al. | |
| 6,279,659 | B1 * | 8/2001 | Brunet | E21B 41/0035 166/117.6 |
| 6,419,026 | B1 | 7/2002 | MacKenzie et al. | |
| 6,732,802 | B2 | 5/2004 | Smith | |

(Continued)

FOREIGN PATENT DOCUMENTS

| | | |
|---|---|---|
| CA | 2425036 | 10/2003 |
| CA | 2766051 | 10/2003 |

(Continued)

*Primary Examiner* — Aaron L Lembo

(74) *Attorney, Agent, or Firm* — Kunzler Needham & Hilton

(57) ABSTRACT

Technologies for facilitating the placement of lateral liners from a main casing including a device for positioning a lateral liner in a lateral wellbore accessed through a window having a V-shaped downhole end, the liner junction placement device comprising: a lateral liner biasing member configured to be positioned between the lateral liner and the lateral wellbore at the window and configured to urge the lateral liner away from one side of the lateral wellbore.

8 Claims, 18 Drawing Sheets

(56) References Cited

U.S. PATENT DOCUMENTS

| | | | | |
|---|---|---|---|---|
| 6,752,211 | B2 * | 6/2004 | Dewey | E21B 43/305 166/117.6 |
| 6,840,321 | B2 | 1/2005 | Restarick et al. | |
| 7,000,704 | B2 | 2/2006 | Smith | |
| 7,104,332 | B2 * | 9/2006 | Murray | E21B 41/0042 166/380 |
| 7,147,057 | B2 | 12/2006 | Steele et al. | |
| 9,422,731 | B2 * | 8/2016 | Gower | E04F 21/185 |
| 9,644,459 | B2 * | 5/2017 | Themig | E21B 43/10 |
| 10,267,126 | B2 | 4/2019 | Themig | |
| 10,774,603 | B2 * | 9/2020 | Glaser | E21B 33/13 |
| 11,078,756 | B2 * | 8/2021 | Maddux | E21B 41/0042 |
| 2003/0150612 | A1 * | 8/2003 | McGarian | E21B 23/02 166/255.2 |
| 2010/0059279 | A1 * | 3/2010 | Saylor | E21B 23/12 175/45 |
| 2016/0076261 | A1 * | 3/2016 | Gower | E04F 21/1805 52/745.12 |
| 2018/0320487 | A1 | 11/2018 | Themig | |
| 2024/0229561 | A1 * | 7/2024 | Themig | E21B 7/046 |
| 2024/0287870 | A1 * | 8/2024 | Themig | E21B 33/146 |

FOREIGN PATENT DOCUMENTS

| | | |
|---|---|---|
| CA | 2683054 | 11/2003 |
| CA | 2430793 | 12/2003 |
| CA | 2492981 | 7/2005 |
| CA | 2985312 | 5/2019 |

* cited by examiner

MULTILATERAL TECHNOLOGIES FOR WELLBORES

FIELD OF THE INVENTION

The invention relates to wellbore tools and operations including, particularly, systems and methods for constructing lateral wellbores.

BACKGROUND OF THE INVENTION

In the oil and gas industry, there is a need to ensure as much production from a formation as possible, while mitigating environmental impacts.

One industry proposal has been to drill a very long wellbore to access far out into a formation from one well head. These long wellbores can be two or three miles long. However, these wells have suffered from poor ultimate recoveries or production per thousand feet of lateral drilled, compared to relatively short laterals.

A better strategy is to employ multilateral technologies. A multilateral strategy employs a plurality of lateral wellbores, each of which extend from a main wellbore. Multilateral wells may have a number of lateral wellbores extending from immediately adjacent main wellbores. A lateral wellbore forms a juncture with the main wellbore from which it extends. Generally, lateral wellbores are accessed through a window removed from the main wellbore wall. Sometimes the window opening is pre-formed in the casing and the lateral is drilled therethrough and extends from the drilled-out pre-formed window. Alternatively, the window is formed entirely by drilling out from the main wellbore by milling through the casing and cement, if any, through the borehole wall and outward therefrom.

While multilateral technologies and processes are known, it has proved difficult to drill and complete multilaterals in a cost-effective and successful way.

The industry continues to seek reliable and cost-effective multilateral technologies.

SUMMARY OF THE INVENTION

In accordance with a broad aspect of the present invention, there is provided a method for orienting placement of a lateral wellbore from a main wellbore, the method comprising: logging a wellbore casing for the main wellbore along a length of the wellbore casing from which the lateral wellbore is to be drilled, the logging being to determine a first circumferential location of a first orientation indicator in the wellbore casing; and setting a whipstock such that a key on the whipstock anchor has a rotational offset from a deflection surface of the whipstock, wherein the rotational offset is selected based an offset angle between the first circumferential location of the first orientation indicator and a desired extension direction of the lateral wellbore from the main wellbore.

In accordance with another broad aspect of the present invention, there is provided a system for orienting placement of a lateral wellbore from a main wellbore comprising: a whipstock including an anchor portion including a key, a deflection surface portion and a connection between the anchor portion and the deflection surface portion, the connection operable to connect and fix the anchor portion to the deflection surface portion in any of a plurality of rotational orientations; and a tubular structure installable in a wellbore casing, the tubular structure including a pocket on its inner diameter configured to receive the key of the whipstock and a first orientation indicator with a characteristic capable of being logged by a logging tool to determine a circumferential location of the orientation indicator within the tubular structure.

In accordance with another broad aspect of the present invention, there is provided a liner junction placement device for positioning a lateral liner in a lateral wellbore accessed through a window having a V-shaped downhole end, the liner junction placement device comprising: a lateral liner biasing member configured to be positioned between the lateral liner and the lateral wellbore at the window and configured to urge the lateral liner away from one side of the lateral wellbore.

In accordance with another broad aspect of the present invention, there is provided a method for placing a wellbore liner in a lateral wellbore extending from a main wellbore, the method comprising: moving the wellbore liner into the lateral wellbore through a window in the main wellbore; biasing the wellbore liner into a position toward an upper end of the window; and securing the wellbore liner in the position.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein:

FIG. 12A illustrates the lateral liner biasing member in the run-in position and FIG. 12B illustrates the lateral liner biasing member biased outwardly;

FIG. 14A is a side isometric view of the biasing member, FIG. 14B is an installation site on a lateral liner for accommodating the biasing member; and FIG. 14C illustrates the lateral liner biasing member installed in the installation site.

DETAILED DESCRIPTION OF VARIOUS EMBODIMENTS

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and, in some instances, proportions may have been exaggerated in order more clearly to depict certain features. Throughout the drawings, from time to time, the same number is used to reference similar, but not necessarily identical, parts.

System for Placement of Lateral Wellbores

In one aspect, a system has been invented for placement of lateral wellbores that facilitates orientation and placement of equipment for drilling of a lateral wellbore from a main wellbore.

In current multilateral strategies it is difficult and expensive to accurately drill the lateral from the main wellbore. In particular, a lateral wellbore is typically drilled by placement of a whipstock within the well. The whipstock's deflection surface is used to deflect a drill string bit/device/mill to form a wellbore that extends away from the main wellbore at the correct depth and direction away from the main bore casing. It takes a great deal of time and effort to accurately position the whipstock's deflection surface, normally requiring a logging run done with the drilling rig for each whipstock that is set, so that the lateral well is drilled at the correct orientation: upwardly, downwardly or sideways (most laterals are drilled in the same horizontal plane as the main wellbore, so the orientation will generally be sideways). In particular, envisioning that the main wellbore has a cylindrical restraining wall, formation logging could indicate that a lateral needs to be drilled to extend horizontally left from the main wellbore, or directly to the right side, and/or any direction 360 degrees from the main wellbore. When laterals require the placement of tools downhole, it is difficult to accurately place the tools to cause the lateral to be drilled along the selected direction.

With reference to FIGS. 1 to 6, a system, including an apparatus and method, for placement of lateral wellbores is illustrated. The apparatus and method facilitate orientation and placement of equipment for drilling of a lateral wellbore from a main wellbore. As such, the system can be employed in a main wellbore 10 to drill a lateral wellbore 12*a* therefrom along a selected direction, arrow A, away from the main wellbore. The system can also be employed to drill further lateral wellbores 12*b*, 12*c* from the main wellbore along further selected paths, arrows B and C.

Figure 1:
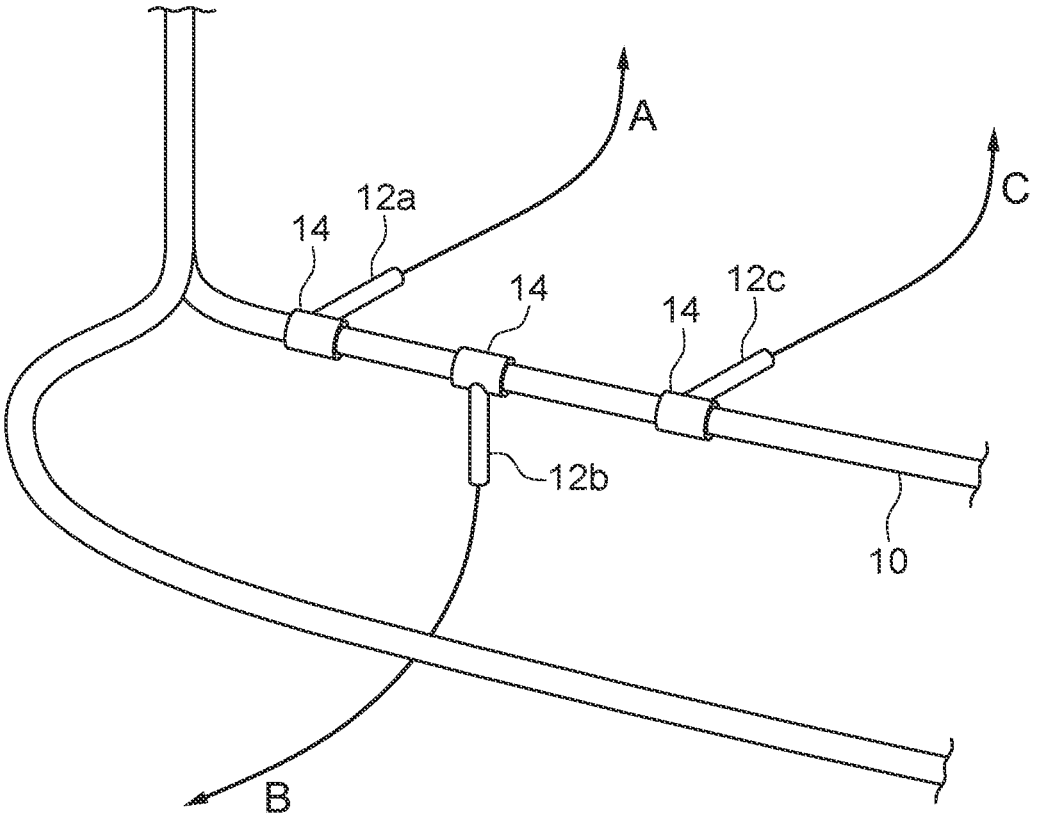
FIG. 1 is a schematic illustration of a system of wellbores including a main wellbore leg and arrows indicating the possible locations of lateral wellbores.

The apparatus includes a coupling 14 for a wellbore casing, sometimes alternatively referred to as a liner, and a whipstock 16 configured to be received in a known orientation in the coupling. In FIG. 1, the system includes three couplings 14 connected into a casing string. These couplings are installed in the casing string during completion of the main wellbore. The couplings act as any other tubular in the casing string but become uniquely useful when it is time to drill a lateral from the casing string. Lateral wellbores 12*a*, 12*b*, 12*c* are each drilled using one of the couplings 14. Each of the couplings has an orientation indicator and each has a whipstock landing site that fits with a whipstock that is configured to be received in a known orientation in the coupling. The direction of each coupling can be identified performing a single logging run that may utilize caliper or imaging to determine that direction. The couplings may all be substantially identical but can be employed to orient the whipstock and drilling equipment operating on the whipstock such that laterals can be drilled therefrom along accurate and selected directions.

Figure 2:
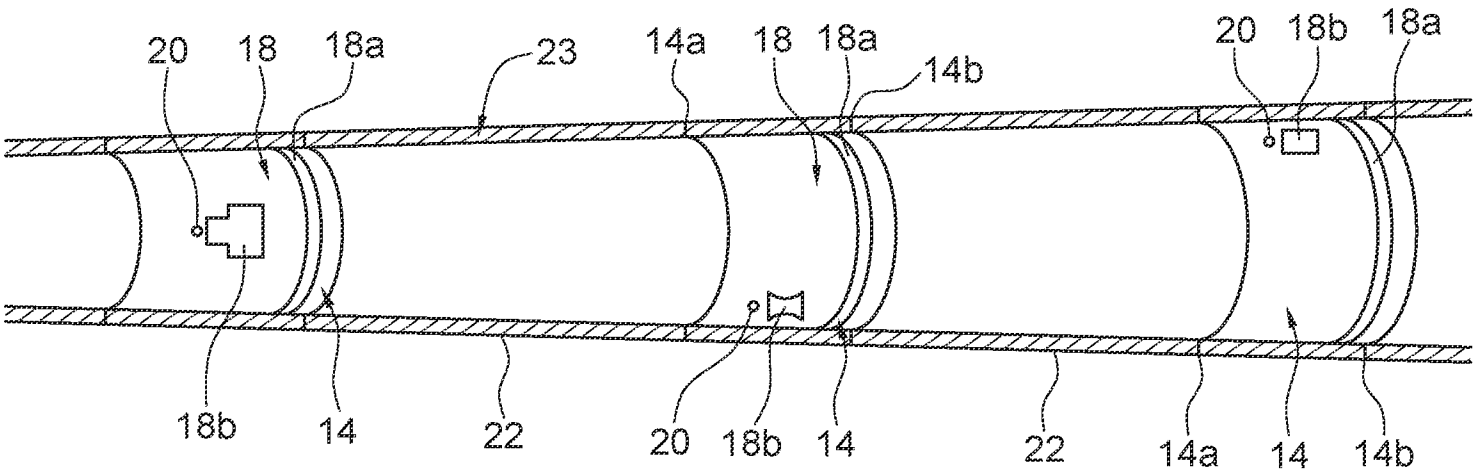
FIG. 2 is a schematic illustration of a section through a well lined with a casing string including couplings for orienting lateral wellbores.
Figure 3:
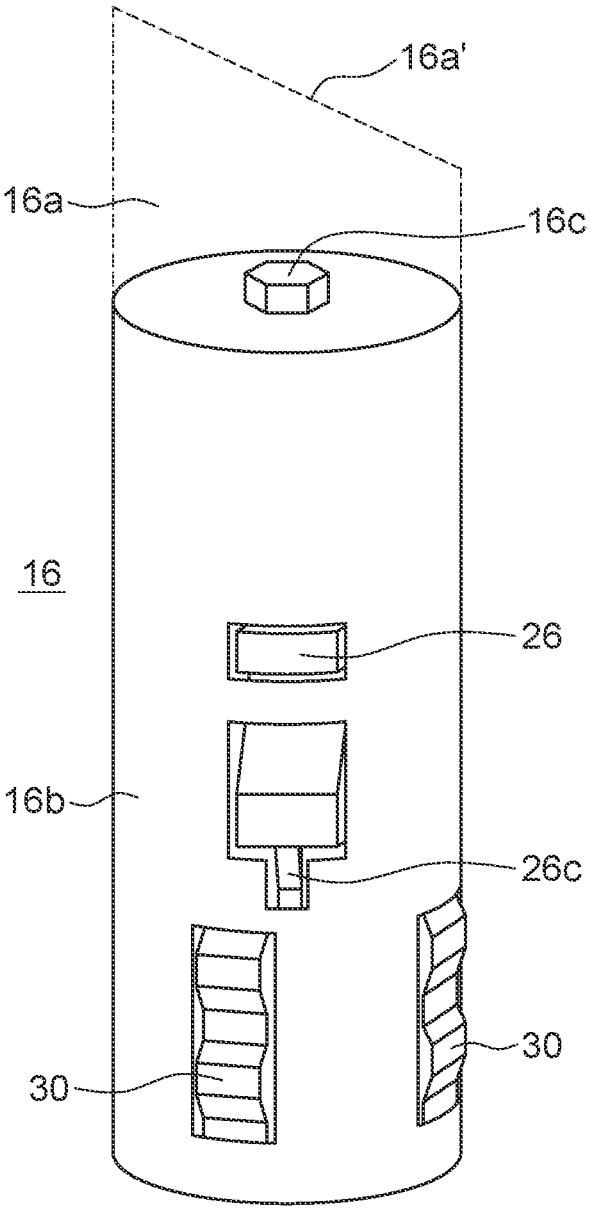
FIG. 3 is a top isometric view of a whipstock anchor useful with a coupling for orienting a lateral wellbore.
Figure 3A:
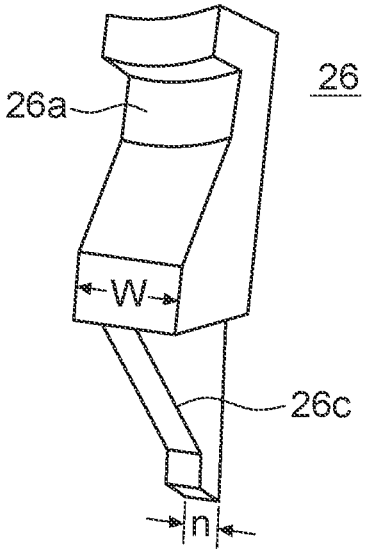
FIG. 3A is a side isometric view of a whipstock orientation key.
Figure 4:
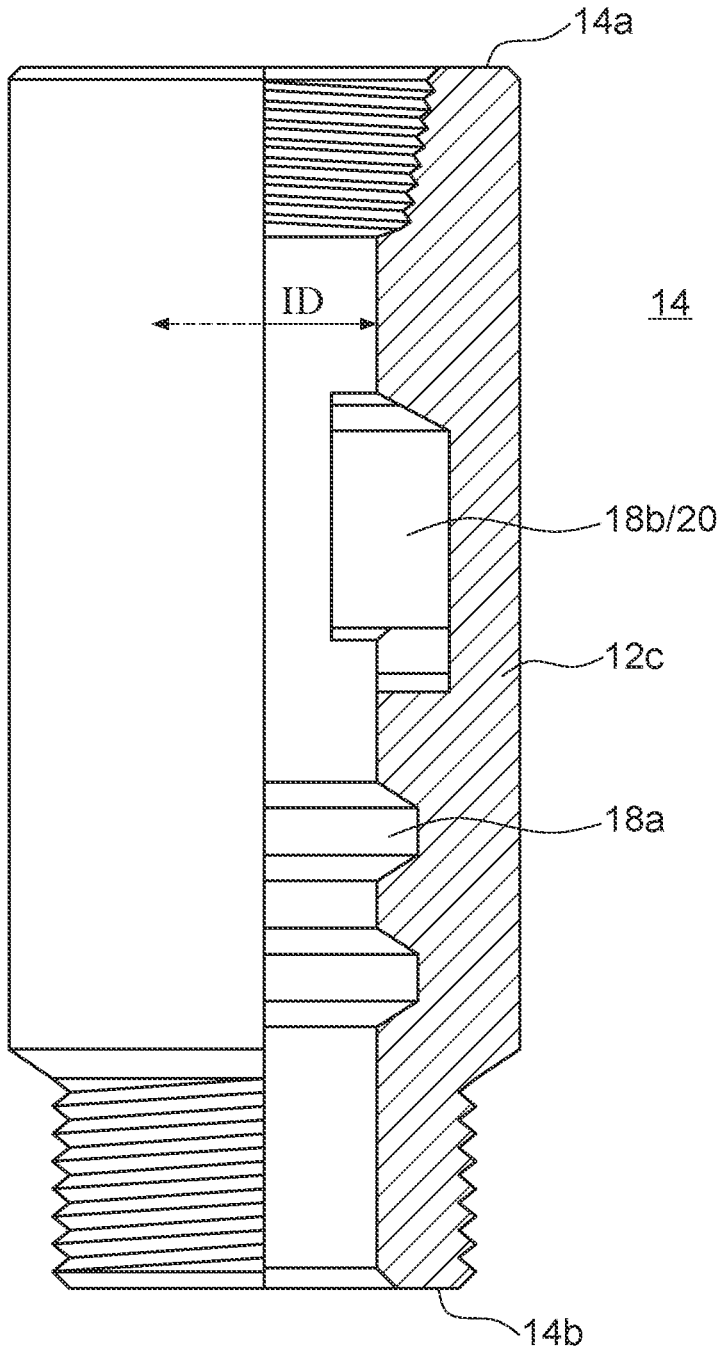
FIG. 4 is a section through a coupling with a locating pocket.
Figure 6:
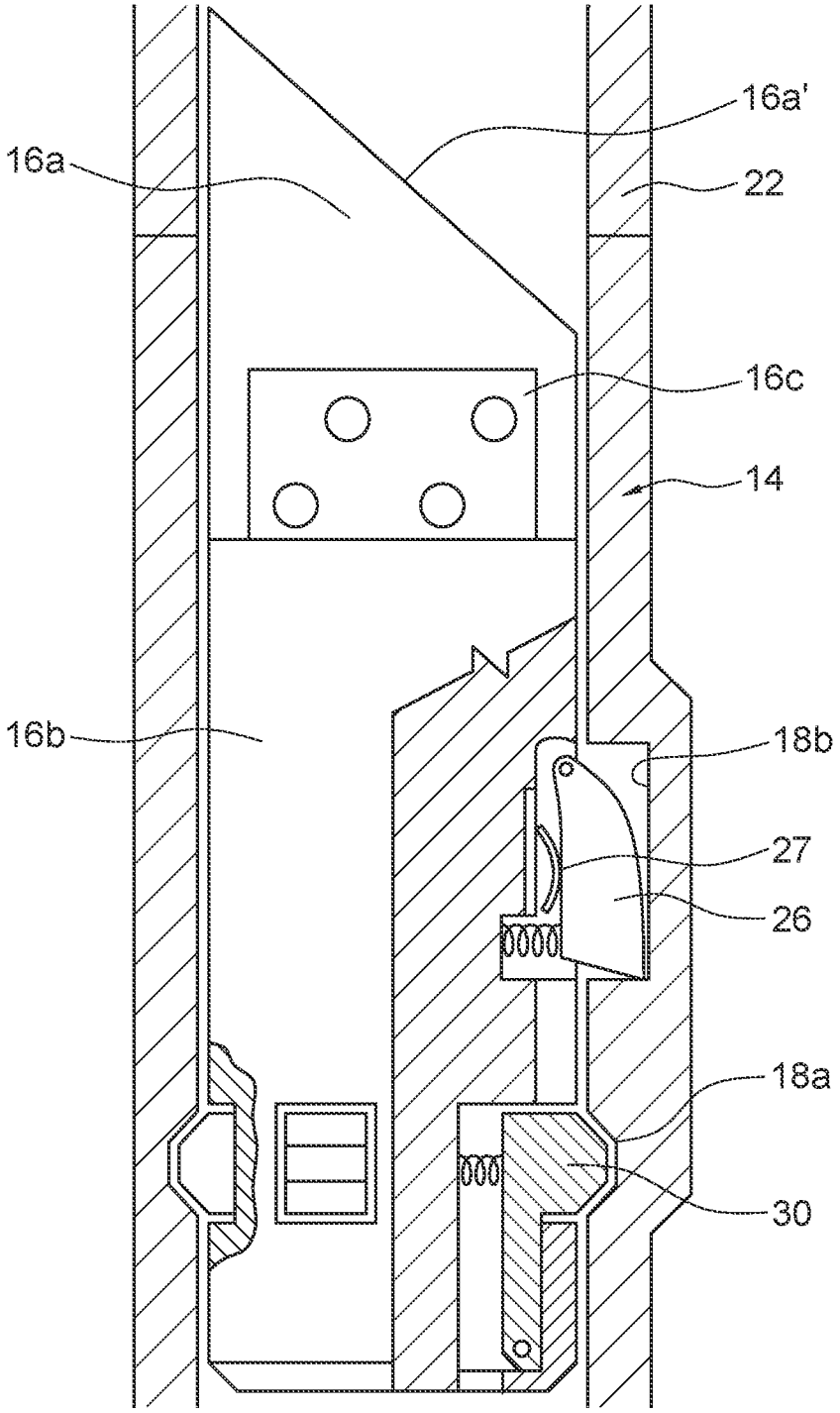
FIG. 6 is a section through a wellbore with a whipstock installed therein.
Figure 7:
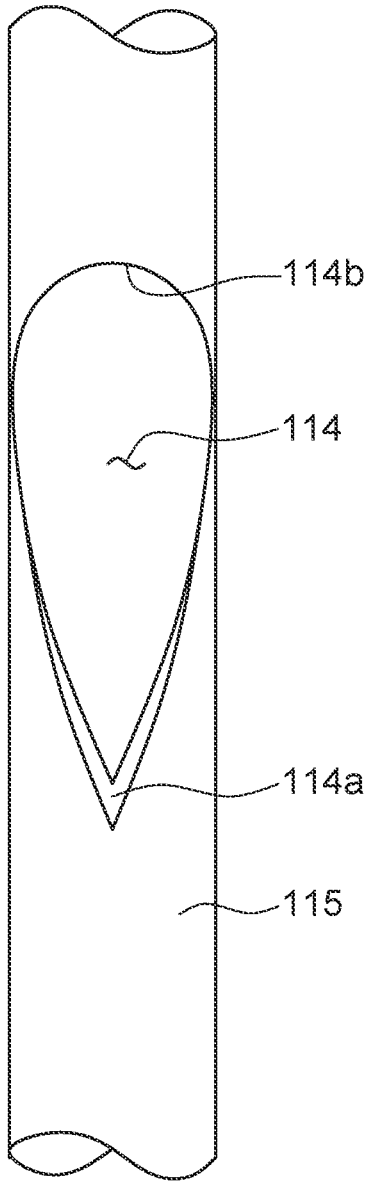
FIG. 7 is an elevation view of outer surface of a main wellbore tubular from which a lateral wellbore is drilled.

Exemplary couplings 14 are illustrated in greater detail in FIGS. 2, 4 and 6. Embodiments of whipstocks 16 are illustrated in greater detail in FIGS. 3, 5 and 6.

Coupling 14 is configured to be installed in a wellbore casing string and includes a whipstock landing site 18 and an orientation indicator 20. As will be appreciated, a coupling is a tubular member with ends 14*a*, 14*b* configured for connection, such as threaded connection, with casing string tubulars 22 to make up a string 23. The coupling may be one integral member, or a plurality of members connected to form the overall tubular member.

One or more couplings 14 are installed in the main casing string when the main casing string is initially installed. While the coupling generally has end 14*a* intended to be closer to surface and end 14*b* intended to be installed closer to bottom hole, it may be installed in any rotational orientation. For example, as it relates to the one or more couplings and the lateral wells to be drilled from the main wellbore, the couplings do not need to be installed or oriented in any set rotational orientation. In particular, when the string is made up with the one or more couplings, the couplings can be connected into the main axis of the string in any rotational orientation. When the string is installed in the well, the orientation indicator 20 of the whipstock landing site 18 can be at any orientation in the coupling and any orientation in the string. For example, when the string is installed in the main wellbore, the orientation indicator 20 of a coupling can be positioned on the right or left side, or on an upper or lower side, as determined by gravity, of the casing and the orientation indicator of one coupling need not be aligned with other orientation indicators of other couplings along the string.

The whipstock landing site 18 is on the inner diameter surface of the coupling and includes surfaces 18*a*, 18*b* configured for receiving installation, and ensuring proper placement, of the whipstock within the coupling and the string. In one embodiment, the whipstock landing site includes an annular profile 18*a* and a rotational locator 18*b*.

The annular profile 18*a* is for example a groove that extends around the inner surface of the coupling, for example orthogonal to a long axis between ends 14*a*, 14*b*.

The annular profile 18*a* is a depth indicator for the whipstock and is sensed and located by a whipstock mechanism, such as drag blocks or slips.

Rotational locking site 18*b* is a physical discontinuity on a selected area around the circumference of the inner diameter of the coupling. Rotational locking site 18*b* acts as a rotational positioning mechanism for the whipstock within the coupling. For example, the whipstock has a shape or mechanism that fits in only one rotational orientation into the rotational locking site, such that the rotational orientation of the whipstock in the coupling can be set. The physical discontinuity can be a faceted area (i.e., a shaped or flat spot, etc.) or a pocket (i.e., a recessed area) in the inner diameter ID surface of the wall 12*c* of the coupling.

The profile 18*a* is circumferential and can be spaced a known distance from the rotational locking site 18*b* of that coupling. profile 18*a* is circumferential and can be spaced a known distance from the rotational locking site 18*b* are recessed in the wall 14*c*. Thereby no obstruction is created in the string by coupling 14.

The orientation indicator 20 in a coupling is anything that can be used as a reference point and identified by logging to determine a rotational orientation of the coupling. In particular, the orientation indicator is anything that can be detected by logging from within the casing string and once detected can be assessed to determine the circumferential location of the rotational locator 18*b* in a coupling. For example, orientation indicator 20 can be (a) a visually identifiable feature, (b) an emitter such as a signal emitter such as a magnet or radio frequency identification (RFID) tag, installed in the coupling and/or (c) a physical discontinuity such as a pocket. Orientation indicator 20 may by identifiable through the use of visual, imaging, signal receivers or caliper tools. The circumferential location of the orientation indicator is known relative to the rotational locking site 18*b* and, therefore, once the location of the orientation indicator is logged, the circumferential location of the rotational locking site 18*b*, and thereby the rotational orientation of the coupling in the well, can be determined. Once the rotational orientation of the indicator is identified, then the location of the locking site is known, for example by calculation. For example, the orientation indicator can be logged to determine if it is on the uppermost point (as determined by gravity) on the coupling or at any position around the circumference and once that is known, the circumferential location of the rotational locking site 18*b*, and thereby the rotational orientation of the coupling, can be determined.

In one embodiment, if rotational locking site 18*b* has a structure that can be located by logging, the rotational locking site can act as orientation indicator 20. In one embodiment, therefore, rotational locking site 18*b* is a pocket, which is an open recess, in the wall of the coupling, and it can be located by logging and therefore also acts as the orientation indicator 20. The rotational locking site pocket 18*b*/20 is open on the interior wall of the coupling but does not pass fully through the wall thickness of the coupling. Pocket 18*b*/20 is present on only a portion of the inner circumference of the coupling. In other words, the recessed area forming the pocket only extends a small portion of the full circumference within coupling, and its location relative to the full circumference of the coupling can be ascertained. The pockets in all the couplings in any string may be the same, but of course if desired there may be some variance between them.

If desired or if there is difficulty logging a rotational locking site pocket 18*b*/20, a visually identifiable orientation indicator or an emitter could be installed in the coupling in addition to the rotational locking site to assist with logging. The emitter can be positioned anywhere on the coupling inner circumferential wall and in a position known relative to the rotational locking site. In one embodiment that includes both an emitter as an orientation indicator and a rotational locking site, the emitter is located in or nearby the rotational locking site.

As noted above, the coupling including its whipstock rotational locking site 18*b* is useful with a whipstock 16 that includes a member that engages with rotational locking site 18*b*. In particular, in use, the rotational orientation of the whipstock within the casing string can be set and known when the member of the whipstock is locked into the rotational locking site 18*b*. In particular, the whipstock may include a deflection surface portion 16*a* and an anchor 16*b* couplable to the deflection surface via a rotationally fixed connection 16*c*. The anchor 16*b* includes a rotational orientation member on its outer diameter that corresponds and works with the rotational locking site 18*b*. Rotationally fixed connection 16*c* fixes the rotational orientation of deflection surface 16*a* on anchor 16*b*. Connection 16*c* may be faceted, pinned, etc. such that once deflection surface 16*a* and anchor 16*b* are connected at connection 16*c*, the parts are axially aligned and deflection surface portion 16*a* cannot rotate relative to anchor 16*b*.

Where the rotational locking site 18*b* is a pocket, for example, the orientation member of the whipstock anchor may be a rotational locking key 26. Rotational locking key 26 may protrude at one circumferential location on the anchor outer diameter and the locking key may be configured to fit into the pocket 18*b*. There is a single key 26 and a single pocket 18*b* in the casing coupling so that the rotational position of the whipstock within the casing is clearly established by landing the key in the pocket.

Rotational locking key 26 may be biased outwardly by a biasing spring 27 from the anchor body and can therefore land and expand out into the pocket 18*b* to thereby lock the rotational orientation of the anchor within the coupling. The locking key 26 can be collapsible until locking into position in coupling 14.

Figure 5:
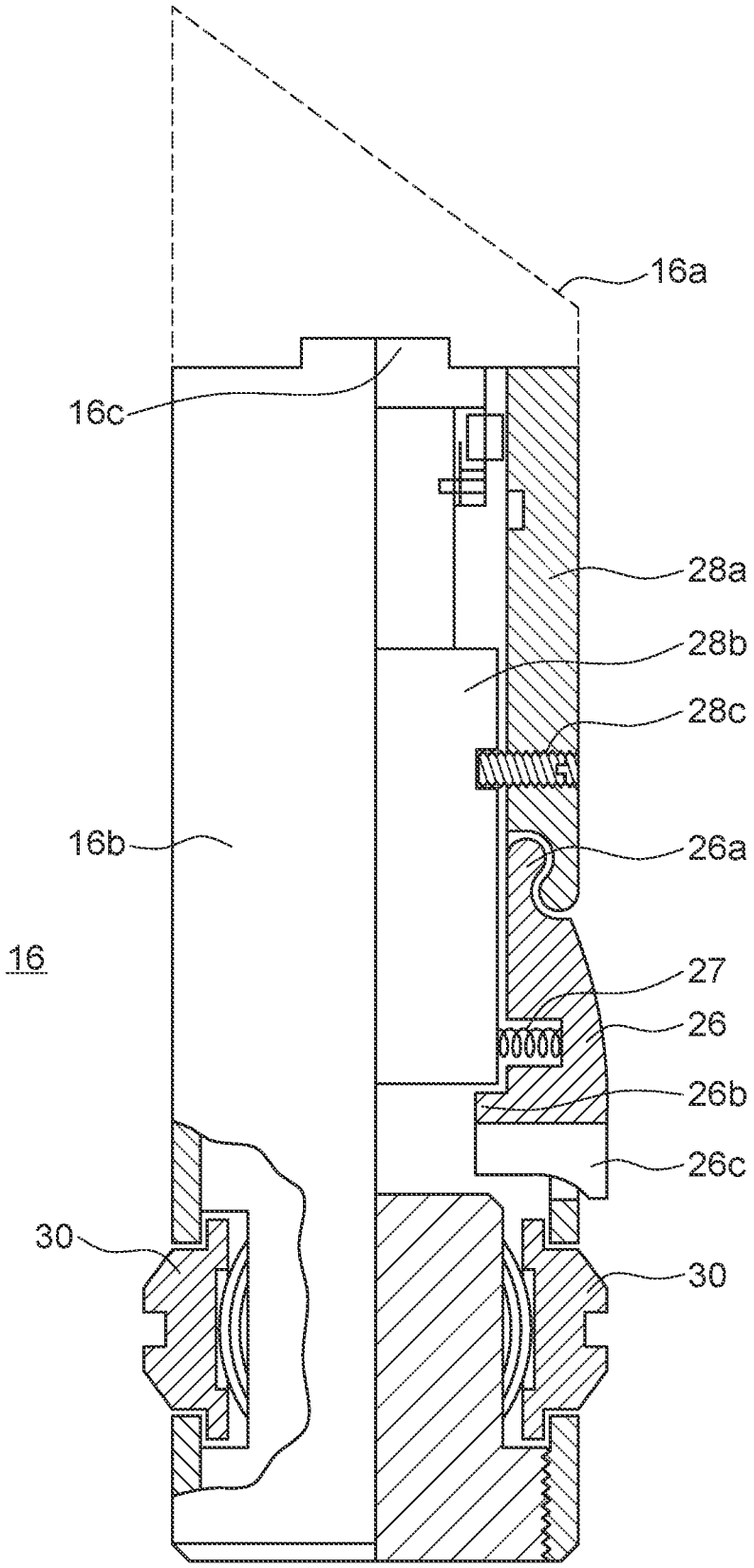
FIG. 5 is a side elevation of a whipstock, partially shown in section.
Figure 5A:
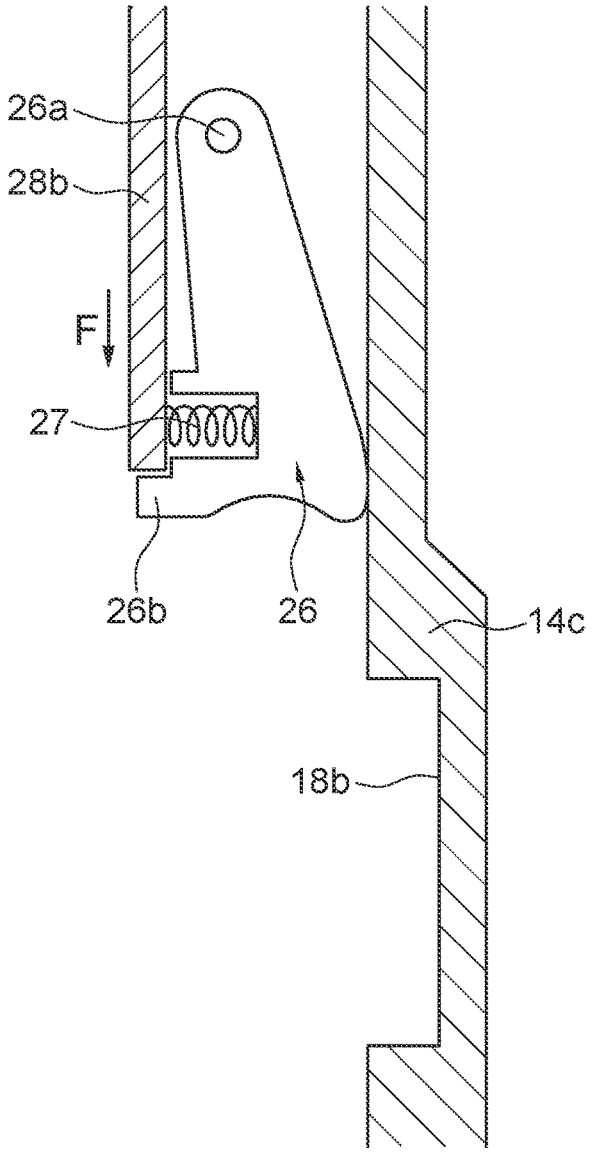
FIGS. 5A and 5B are side elevation enlargements of a whipstock orientation key positioned and locked, respectively, in a locating pocket within a casing.

In one embodiment, locking key 26 includes a selectable lock mechanism that releasably locks the locking key in a radially extended position, such as when it is located in a pocket 18*b*. The selectable lock mechanism can be set by compression of the whipstock anchor 16*b* (arrow F). Later, the selectable lock mechanism can be released, so the key can collapse, by pulling up on the anchor. In one embodiment, for example, the whipstock anchor has an outer body portion 28*a* and an inner sleeve 28*b*. Inner sleeve 28*b* is normally retained, for example, by a shear release mechanism 28*c*, in a position relative to outer body portion 28*a* that allows key 26 to collapse or expand around a pivot point 26*a* (FIG. 5A).

Figure 5B:
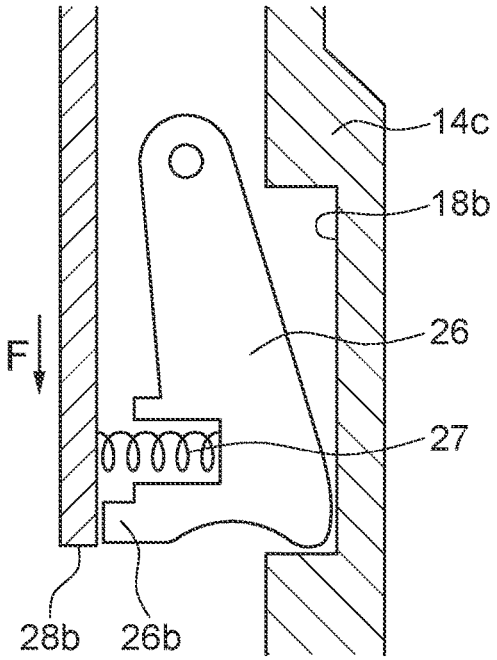

However, compression of anchor 16*b*, such as by applying a downward force on outer body portion 28*a* when key 26 is positioned in pocket 18*b*, overcomes shear release mechanism 28*c* and drives inner sleeve 28*b* behind a lockout portion 26*b* of key 26 (FIG. 5B). When it is desired to remove key 26 from the pocket 18*b*, inner sleeve 28*b* can be pulled up, for example by pulling up on the anchor, to move the sleeve from behind the key. Key 26 can then collapse and be pulled out of pocket and move to another location or be pulled out of the string.

In one embodiment, rotational locking key 26 can include a ramped lower end 26*c* that can ride easily over the string inner surface. The lower end may for example have a minimal thickness (protruding dimension) at its bottom end, which gradually increases to a greater thickness (protruding dimension) at an upper end. Lower end 26*c* may be narrower n side to side than the width w of upper end so that abrupt shoulders are exposed between lower end 26*c* and the upper end to lock key 26 against moving downwardly once locked in a pocket 18*b*.

The whipstock anchor can also include axial locks, such as outwardly biased dogs 30, that fit into circumferential profile 18*a*. The dogs 30 can be normally biased out, for example by springs, so that they drag along the string inner wall and locate the recessed profiles 18*a* as the whipstock is run along the string. Dogs 30 can be spaced a distance from key 26 that is the same as the distance from profile 18*a* to pocket 18*b*. Thus, when dogs 30 are located in profile 18*a*, the whipstock can be rotated to locate key 26 in pocket 18*b*.

Overall, therefore, a method and a process have been invented where a casing string can be run with a plurality of the above lateral orientation couplings 14. As noted, when the string is run in, it doesn't matter, nor is it required to know initially, in what direction the rotational locking site 18*b* and orientation indicators 20 in the couplings are pointed.

When it is desired to create a lateral from the main wellbore, a logging process is conducted to determine the orientation of each coupling. In other words, a logging run is conducted to determine where the orientation indicator is on the circumference, for example, on the upper side, lower side, or left or right sides, or, for example, between 1 and 360 degrees, where 90 degrees is on the bottom, in each coupling of interest. The logging run locates the rotational orientations of the orientation indicators in the couplings of interest, and for example logging can be visually, via signal receiver or with a caliper logging tool. The logging information, once obtained, is valid for the life of the well.

After logging to identify the orientation of each orientation indicator of interest in the string, the rotational locking site 18*b* locations will be known. The whipstock 16 can be set up for each coupling based on the logging information. The logged information and from that the location of the locking site 18*b*, are used so that an appropriate adjustment can be made between the whipstock key and the whipstock deflection surface without further logging or intervention. In particular, the whipstock can be set up so that its rotational orientation member 26 of its anchor 16*b* will fit into the rotational locking site 18*b* in the coupling 14, while the deflection surface 16*a* is aimed in the proper direction to deflect a drill string into the selected direction for a lateral to be drilled. That is the deflection plane of the whipstock, when installed with its rotational orientation member 26 engaged in site 18*b*, is centered on the intended direction of the lateral. Setting up the whipstock includes mounting the portion with deflection surface 16*a* onto anchor 16*b* via the connection 16*c*, which causes deflection surface 16*a* to be rotationally fixed on anchor 16*b*. For example, if a logging run indicates that an orientation indicator is facing north and the operator wants to drill a lateral north, then the operator sets up the whipstock with the deflection face 16*a* axially lined up with the rotational orientation member 26 on the whipstock anchor. On the other hand, if in that scenario where the orientation indicator is facing north, a decision was made to drill the lateral straight south, then the whipstock deflection surface is rotated 180 degrees from the rotational orientation member 26 on the whipstock anchor and fixed in that orientation via connection 16*c*. Then, the whipstock can be run into the well.

The profiles 18*a* are useful to indicate depth. So, while all the couplings can be substantially identical, the profiles can be used to monitor the depth of the whipstock as it is being run in. The profiles are circumferential and can be spaced a known distance from the orientation indicator of that coupling. Therefore, when a whipstock is run in, the anchor dogs 30 catch in profiles 18*a* and indicate depth. When the anchor snaps into the profile of interest, the anchor can be rotated and the rotational orientation member 26 becomes lined up to drop into its pocket 18*b*. The whipstock deflection face is thereby oriented in the correct direction. Then when the anchor is set down, it will lock in place with the whipstock already facing in the correct direction.

Once proper depth and orientation are confirmed, additional force (compression) will set the lock out and lock the tool in place after which it will require substantial force before it can be moved/retrieved.

If a whipstock is run through and accidentally locates in an incorrect coupling, the whipstock anchor can be picked up, rotated so the orientation member 26 is moved out of its pocket 18*b* and then the whipstock can be pushed through to another coupling further down.

The whipstock for any particular coupling can be set up with the defection face and the orientation member aligned or offset by the correct amount in the shop based on the logged information, so rig time is not wasted.

While the above noted description relates to a system where couplings 14 are installed in the main casing string when the main casing string is initially installed, a coupling as described above can be configured with an installation mechanism, such as exterior slips or annular packing elements, on the coupling outer diameter. As such, one or more of the couplings can be run in and installed in an existing casing string to facilitate lateral drilling operations therein.

Placement of Lateral Liner

Another invention for facilitating the placement of lateral wellbores relates to technologies at a lateral liner junction.

With reference to the drawings FIGS. 7 to 15, a lateral wellbore 110 extends from a main wellbore 112 at a juncture. After drilling the lateral wellbore 110 from the main wellbore 112, the lateral wellbore extends at an acute angle from the main wellbore. Since wellbores are generally formed to have circular cross sections, a window 114 from the main wellbore to the lateral wellbore is often elliptical or teardrop, as shown, in shape having a substantially V-shaped downhole end 114*a* and a more rounded upper limit 114*b* at the upper end of the lateral wellbore. Window 114 may be preformed or removed downhole from the main wellbore wall or casing 115 and allows access to the lateral, which extends beyond the window at an acute angle from the main wellbore. Upper limit 114*b* is located at the junction between the main wellbore and the lateral wellbore at the end of the window closest to surface, which is where the upper edge 116 of the lateral wellbore first extends away from the main wellbore. V-shaped downhole end 114*a* is a sharp edge and is predictably shaped.

Figure 8B:
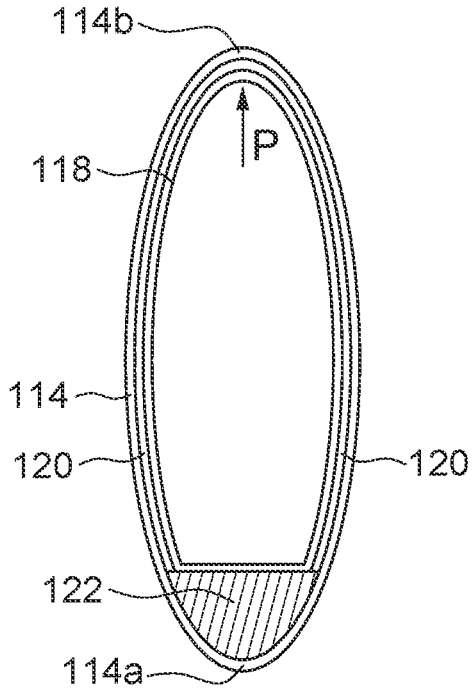
FIG. 8B is an elevation view of the junction of FIG. 8A from within the main wellbore.
Figure 8A:
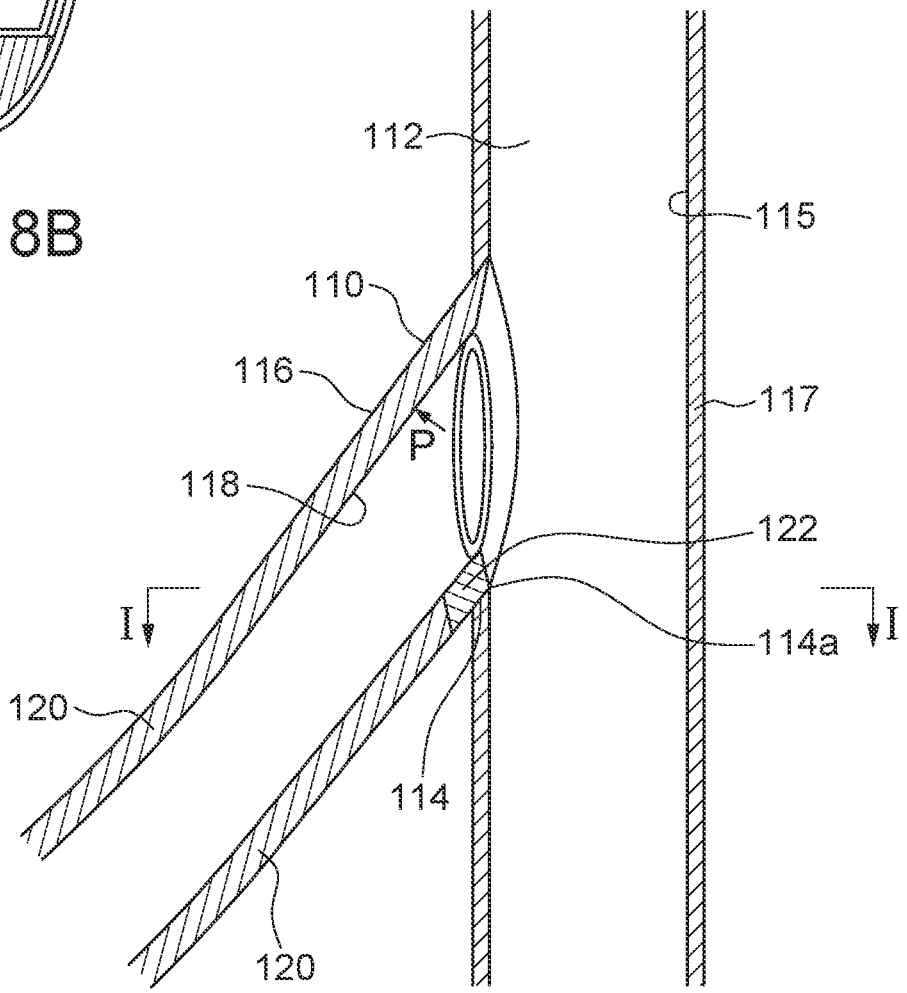
FIG. 8A is a vertical section through a wellbore junction of a main wellbore and a lateral wellbore.
Figure 9:
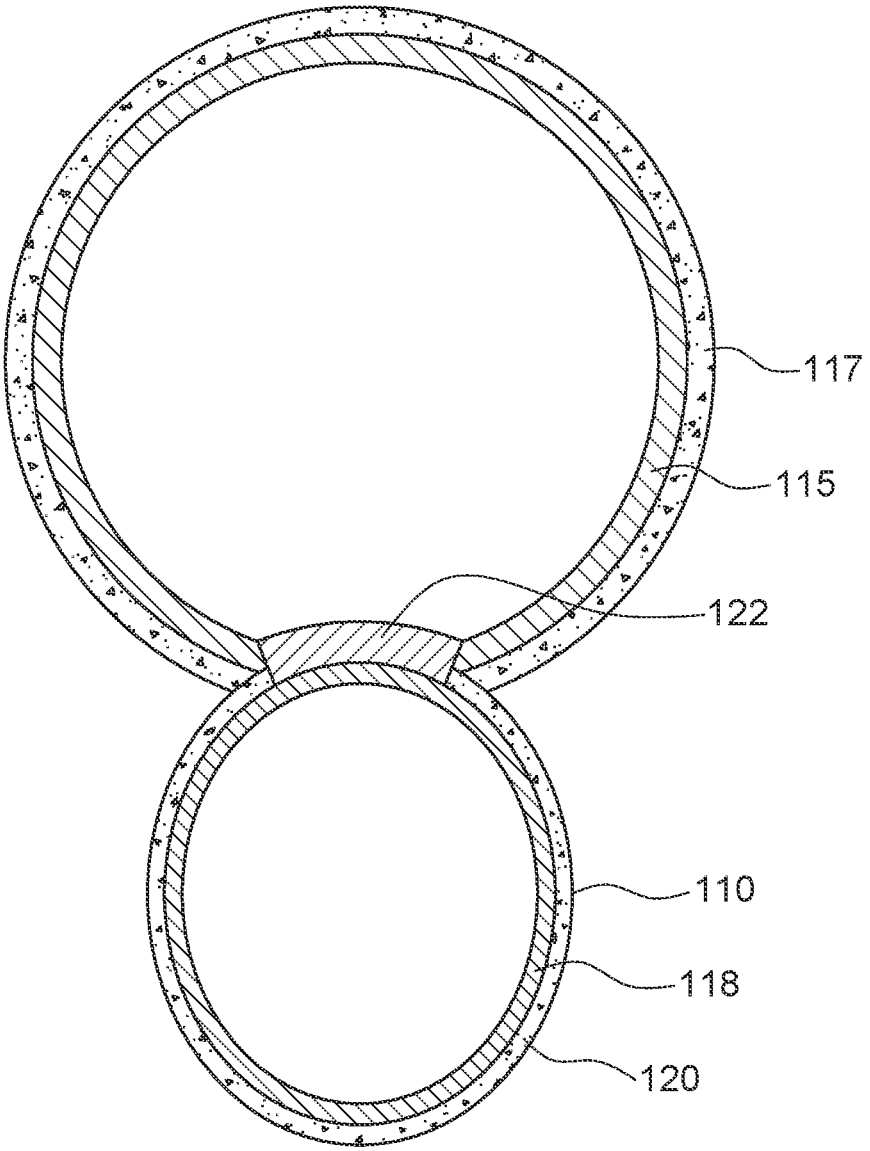
FIG. 9 is the section along lines I-I of FIG. 8A.

In the illustrated junction of FIGS. 8A, 8B and 9, the main wellbore 112 is shown cased with casing 115 and completed with annular cement 117 between the casing and wellbore wall. In unconventional formations, it is desirable to also line the lateral wellbore with a liner 118 and possibly introduce cement 120. In unconsolidated formations, any exposed borehole can begin to degenerate and possibly even cave in, especially when wellbore operations begin. Therefore, the liner 118 can be important. It is sometimes difficult, however, to accurately position the liner relative to the main wellbore window. It is also sometimes difficult to introduce cement 120 between the lateral liner 118 and the lateral wellbore wall.

If the lateral liner is not properly placed and secured, it can become a deterrent to reentry into the lateral wellbore. In fact, an upper side of the liner such as at upper limit 114*b* of the window has been found to be the area of greatest interest, as the liner at that point can fall down and protrude into the main wellbore and create a catch that stands in the way of reentry to the lateral and access to the main wellbore below the lateral.

In this solution, a biasing member 122 is used for the lateral liner 118 at the junction to urge the lateral liner against the upper end 114*b* of the window 114. The biasing member 122 may be positioned at a lower edge of the lateral junction and is configured to bias, for example push (arrows P), the liner upwardly towards the upper portion 116 of the lateral well at the upper end 114*b* of the window. The biasing member may be configured to act to bias the lateral liner in response to axial movement of the liner into the lateral wellbore. This bias is generally toward the uphole side of the lateral wellbore, as described below, or to the side where the lateral is drilled out horizontally or as caused by milling operations.

Operations can be facilitated in a lateral wellbore with the biasing member, where the biasing member causes the liner to be positioned close up against the upper end of the window, which is the uphole side of lateral wellbore at the junction. In particular, the liner is positioned up near or against the upper end of the window and so there is a more gradual entry angle to the lateral and the lateral liner does not tip out into the main wellbore to create a catch. Further, it is easier to introduce cement 120 to fill in the bottom annular area of the lateral. Therefore, the biasing member 122 causes the lateral to be easier for reentry, easier to cement and more stable over time.

Biasing member 122 may be configured to act as a locator for locating the V-shaped bottom end 114*a* of the window. The biasing member can be coupled to, for example carried on (i) the lateral liner outer surface near the upper end of the lateral liner such as on a lateral transition joint or (ii) on a lateral liner installation tool such as a run-in tool, a lateral transition joint or a whipstock.

Biasing member 122 also is configured to act as a biasing mechanism that urges the lateral liner away from the location of the biasing member and up against the diametrically opposite side of the lateral wellbore. For example, where biasing member becomes located at the V-shaped bottom end 114*a*, the biasing member urges the lateral liner towards the uphole side 116 of the lateral wellbore, which is the side closest to surface and immediately adjacent the upper end 114*b* of the window. If cement or another juncture structure is used to secure the liner in place, the biasing mechanism can be removable. However, generally, the biasing mechanism is configured to remain in place, even if the lateral well bore has a cemented annulus. The biasing mechanism can be cuttable/millable in case it protrudes into the path of a milling or cutting tool, where a completion cuts the lateral liner at the window.

In one embodiment, the biasing member 122 may include a key that protrudes outwardly from the structure on which it is coupled. For example, biasing member 122 may include a key that is a structure that is coupled to, and protrudes radially outwardly from, an outer diameter of the lateral liner. The key can be ramped from a leading, lower end to an end closer to the upper end of the liner, so that the key does not catch on inconsistencies on the inside of the main wellbore. Also, with a ramped construction at the lower end, the further the liner is run into the lateral well, the more the key pushes the lateral liner towards the opposite side of the junction.

The key may be shaped catch against the window edges and to locate the V-shaped bottom end of the window. The key can be narrower from side to side at the leading, lower end than the upper end. The key may also include stepped side edges that abruptly protrude from the surface onto which the key is coupled.

Additionally or in another embodiment, the key is configured as a travel limiter and so, once the key locates the window, for example, finds the V-shaped end of the window location, the key is stopped from moving further into the lateral wellbore. In such an embodiment, the key may include an abruptly protruding surface facing the leading, lower end, for example, from which the ramped leading end extends.

In one embodiment, the biasing member key can be configured to be outwardly pivotable. In such an embodiment, the key can include a linkage 124 pivotally connected to a body 126. The linkage and body are connected to the lateral liner and to each other via pivot points 128. The linkage 124 and body 126 hinge out relative to the lateral liner outer surface when the key locates the window, such that the biasing member hinges out and pushes the liner toward the top of the junction as the liner is moved into the lateral wellbore.

A biasing member is shown that includes linkage 124 and body 126 installable on an outer diameter of the lateral liner 118 at its junction end. Linkage 124 may be narrower than body 126 and may be ramped from its lower leading end 124*a* to the end at which it is connected to body 126. Body 126 has steep, downwardly facing flanks 126*b* and side edges 126*c* that can catch on the edges of window and the V-shaped lower end 114*a*. The linkage 124 and body 126 pivots out (arrow R) when the flanks 126*b* catch on and are stopped against the window and the liner continues to be run in down past the window. The linkage 124 may be configured to slide (arrow S) at one end 124*a* along the liner, while an end 126*a* of the key is secured against movement relative to the liner. The biasing member hinges out based on lateral translation.

A spring 130 can be employed to urge the pivotal biasing member into its outwardly hinged position.

There are options for constructing the biasing member as shown in FIGS. 12A to 15.

Figure 12A:
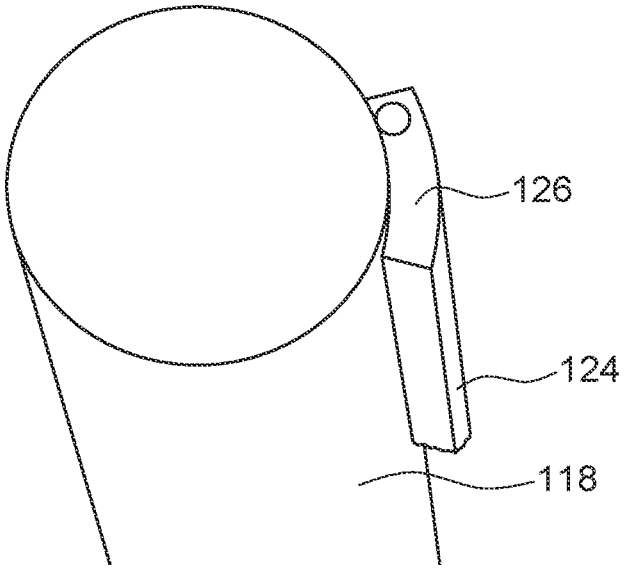
FIGS. 12A and 12B are schematic illustrations showing another embodiment of a lateral liner biasing member, where
Figure 12B:
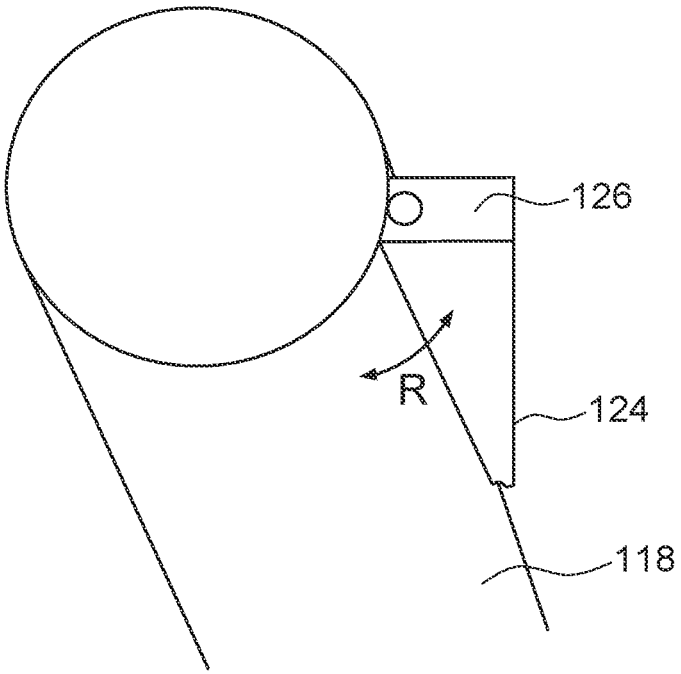

In FIGS. 12A and 12B, the key pivots in an arc, arrow R, away from the liner when the key is caught on the window. The pivotal action at ends 124*a*, 126*a* is about axis that are substantially parallel with the long axis of the lateral liner.

Figure 13:
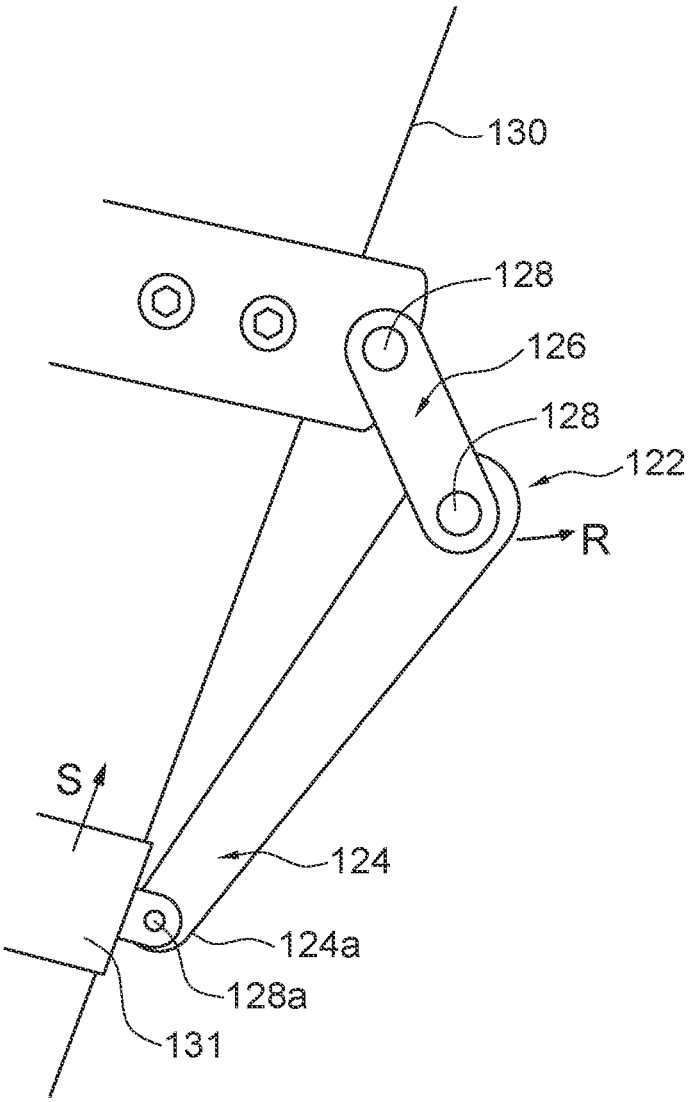
FIG. 13 is a side elevation of a lateral liner biasing member.

In FIG. 13, the biasing member including linkage 124 and body 126 is positioned on a transition joint 130. End 124*a* is secured via a pivotal connection 128*a* to a collar 131 that slides, arrow S, along the transition joint 130.

Figure 14A:
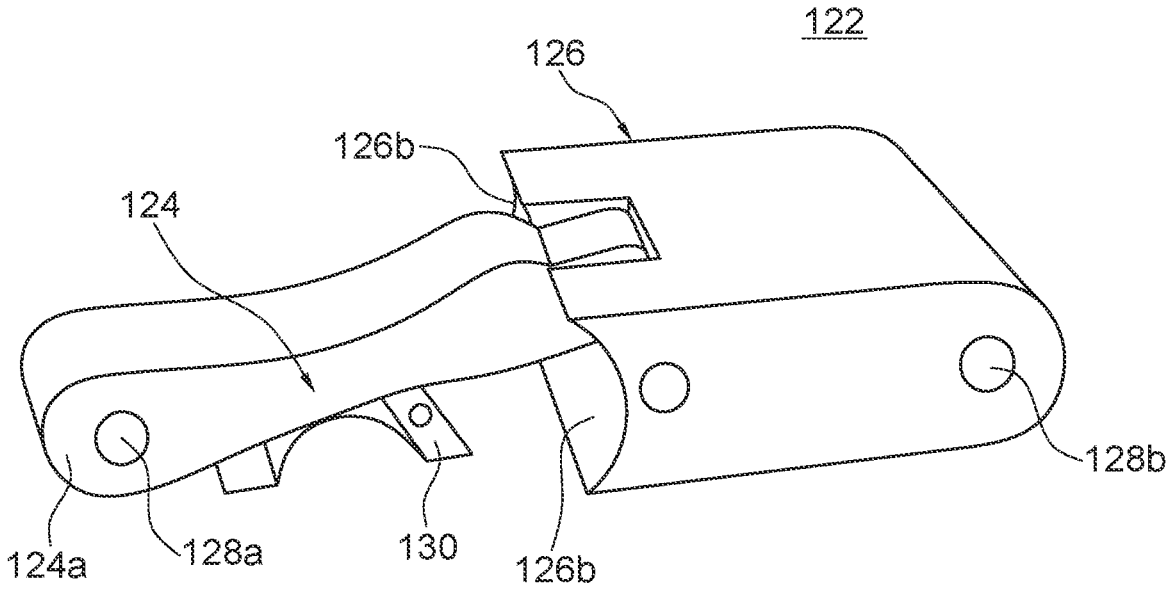
FIGS. 14A, 14B and 14C are views of another embodiment of a lateral liner biasing member, where
Figure 14B:
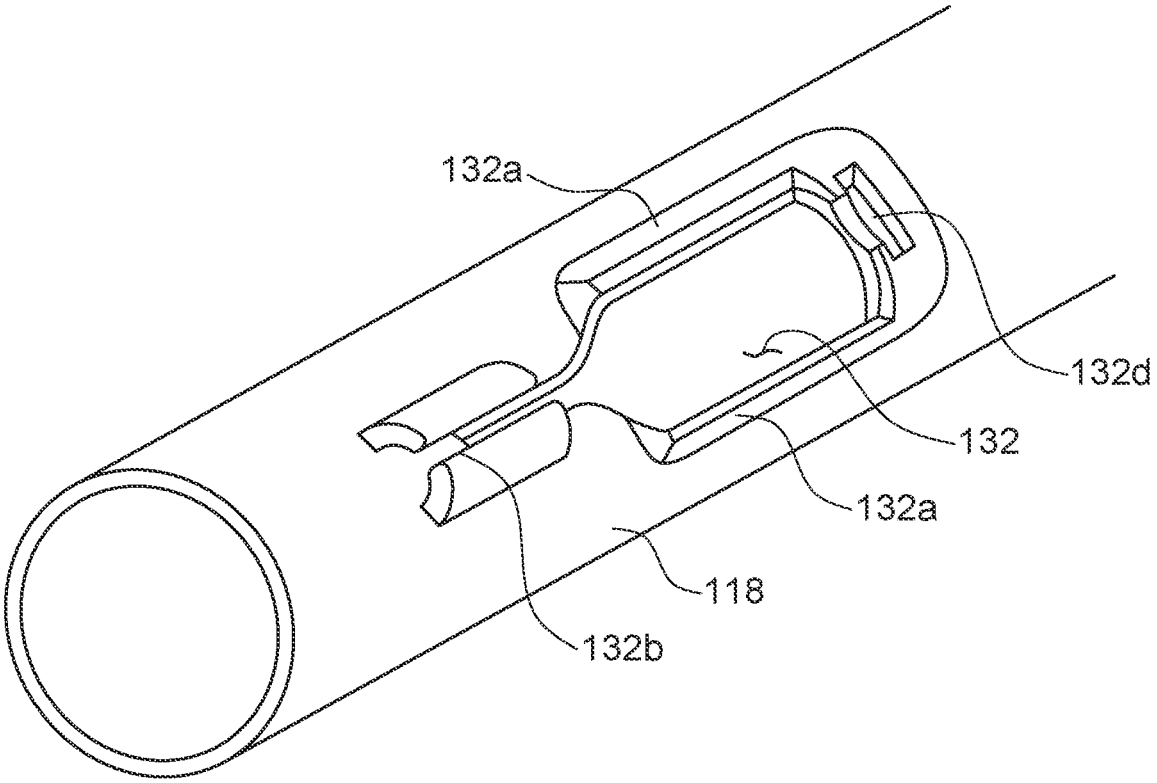
Figure 14C:
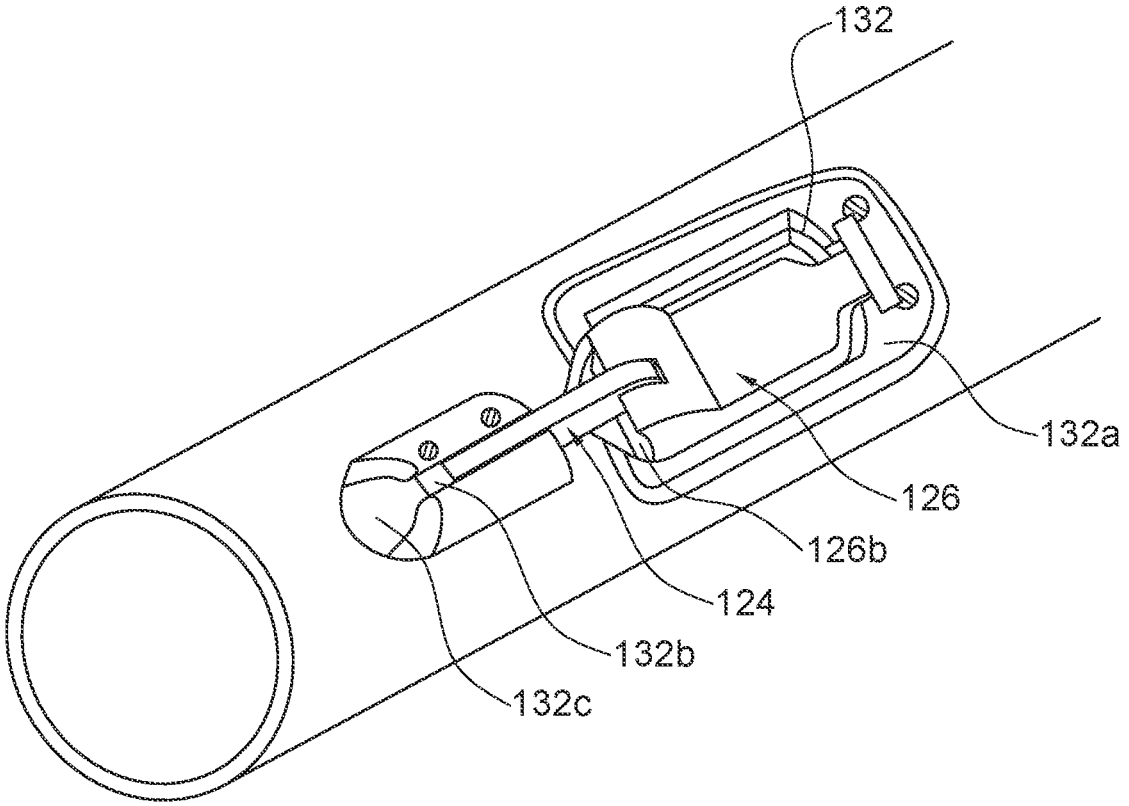

In FIGS. 14A to 14C, the biasing member 122 is installed in a recess 132 in the outer surface of the lateral liner 118. The recess is shaped to accommodate the key linkage 124 and body 126 and to receive pivotal connections 128*a*, 128*b*. The walls that define recess 132, which can include built up perimeters 132*a*, can protect the linkage and body 126 while running in.

Recess 132 includes a slot 132*b* extending along a length of the outer surface of the lateral liner 118. Slot 132*b* creates a track along which linkage 124 can slide. A pivot pin at pivotal connection 128*a* and end 124*a* can slide along slot

132*b*. Slot 132*b* can be closed at its lower end by a ramped cap 132*c* and pins can be installed to limit the movement of the linkage.

A pivot pin at pivotal connection 128*a* is received and captured at site 132*d*.

Flanks 126*b* of body 126 protrude beyond the recess and edges 132*a* at least when biased out by spring 130. Flanks 126*c* may be concavely shaped, with a concave groove extending laterally away from linkage 124, to define a shape configured to more actively catch and be retained in engagement with the edges of the window 114.

Figure 15:
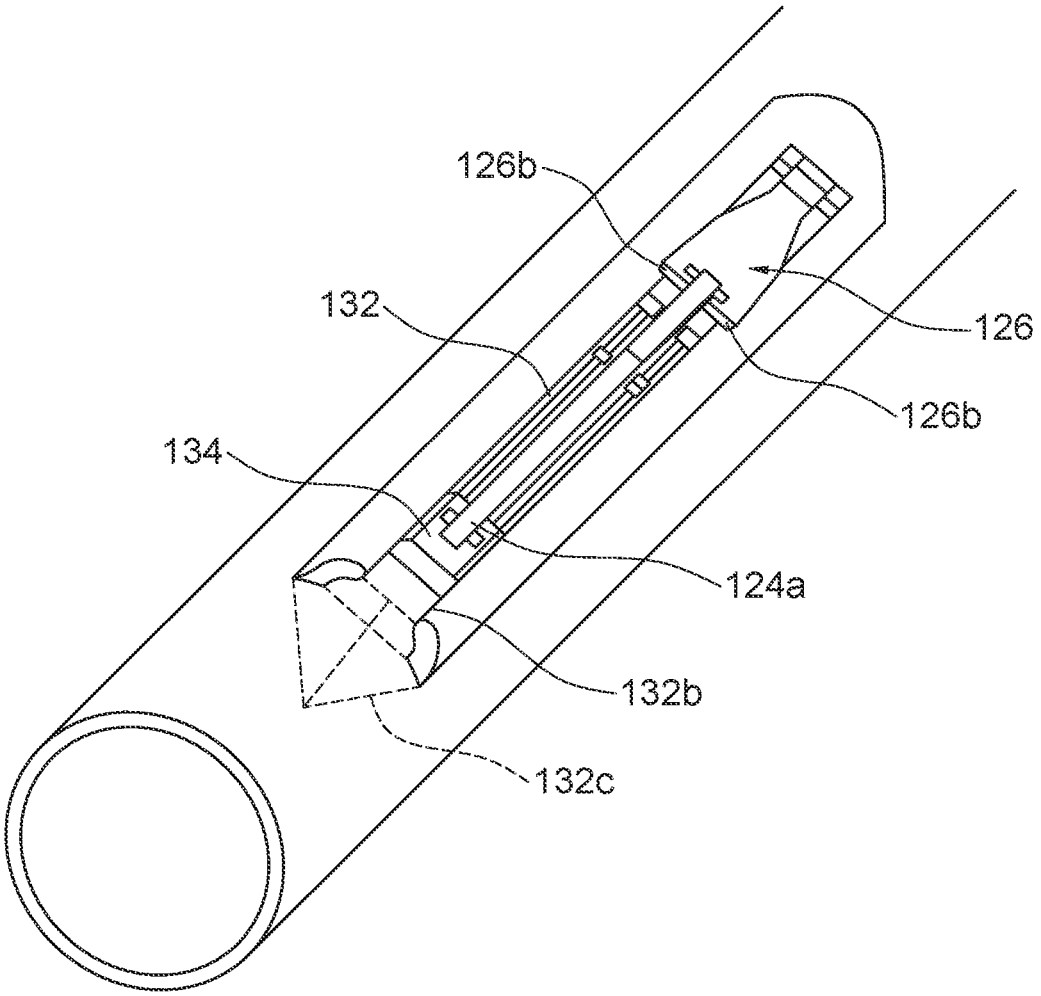
FIG. 15 is a side isometric view of a lateral liner biasing member installed on a lateral liner.

In FIG. 15, end 124*a* of the linkage is pivotally connected to a slider 134. Slider 134 is retained in and slides along slot 132*b*.

Flanks 126*b* of body 126 protrude laterally away from and downwardly beyond the pivotal connection to linkage 124. Thus, flanks 126*b* create a protruding hook when the key pivots out that catch on the edges of the window 114.

The method for installing a lateral liner includes biasing the lateral liner towards the upper end of the lateral wellbore bore. The lateral liner is secured in that position closer to the upper side of the lateral wellbore than to the lower side of the lateral wellbore to facilitate reentry, to support the upper side of the wellbore against cave ins and to facilitate cementing. In one embodiment, the force of moving the lateral liner into the lateral wellbore is actually converted into a biasing force to bias the lateral liner toward the upper side.

Figure 10:
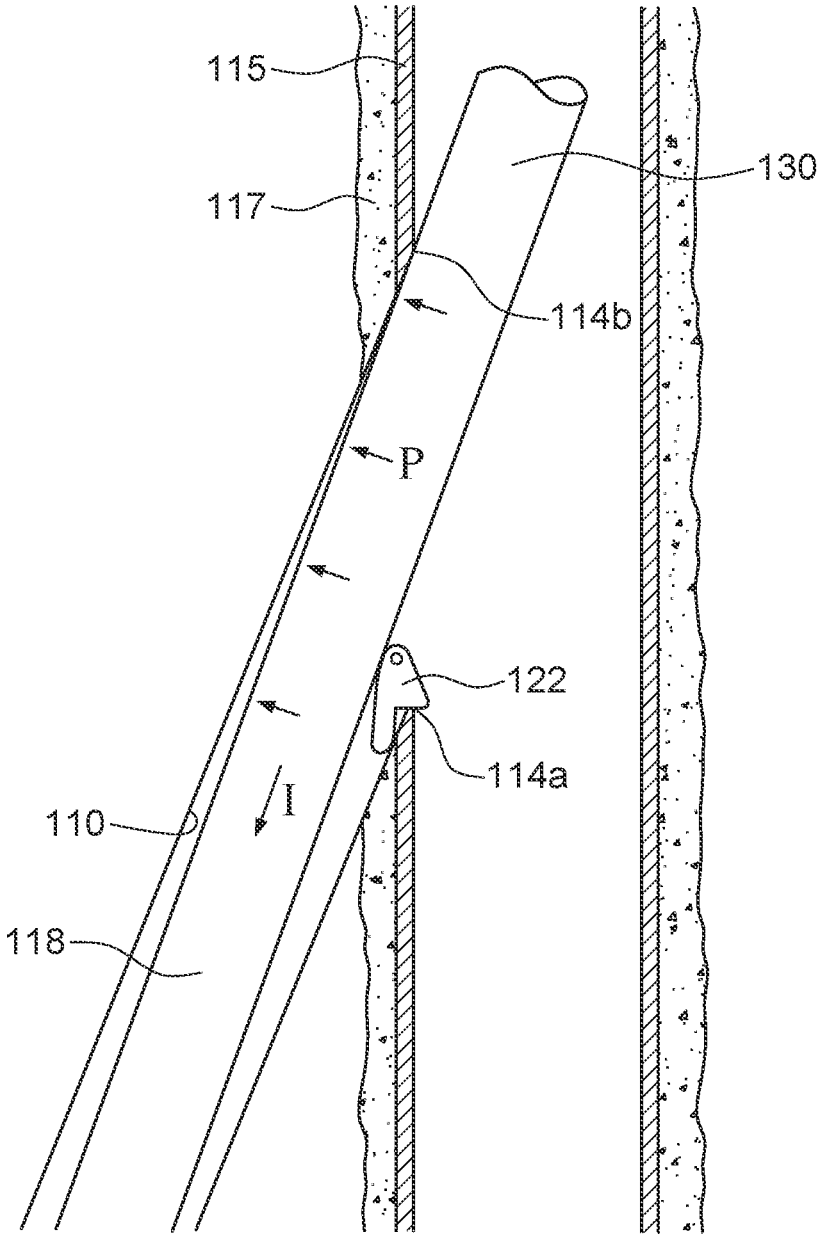
FIG. 10 is a schematic illustration showing a lateral liner being installed in a lateral wellbore.
Figure 11:
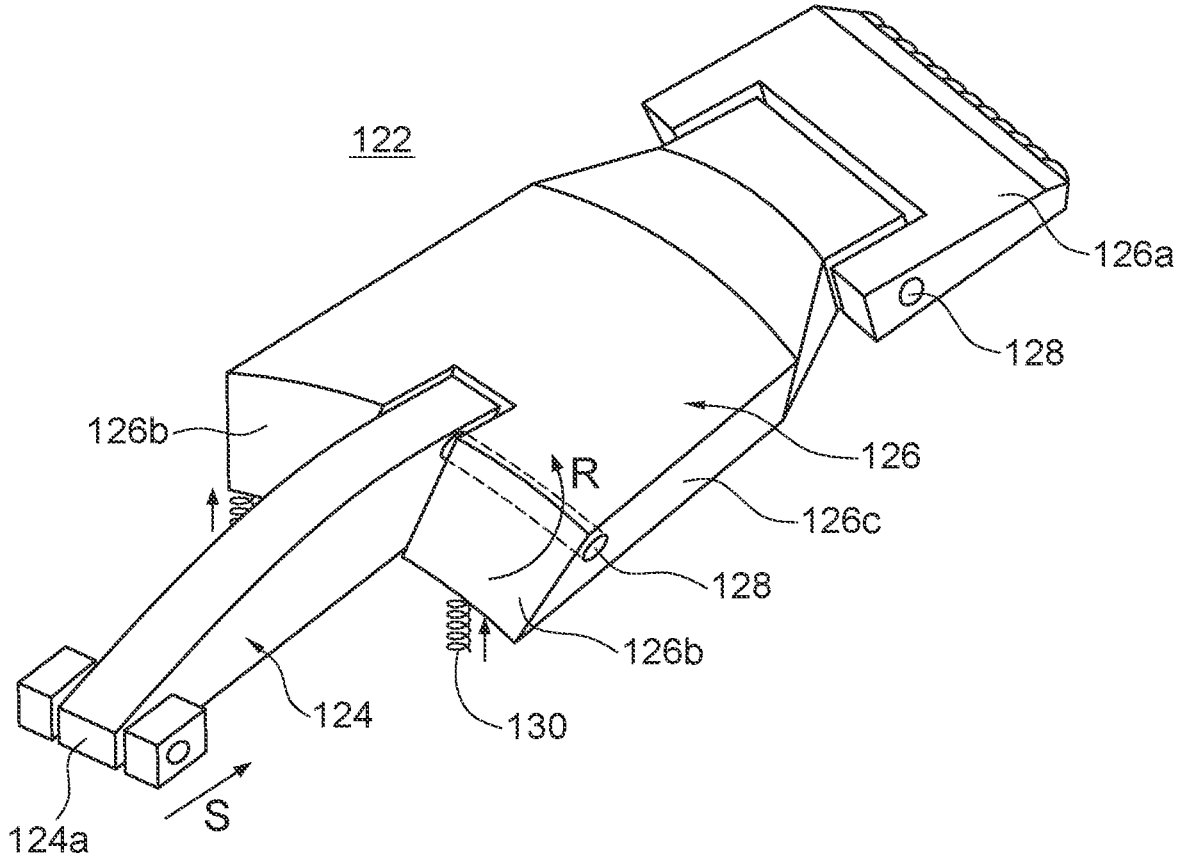
FIG. 11 is a side isometric view of a lateral liner biasing member.

In one embodiment, such as that shown in FIG. 10, a method for placing a wellbore liner 118 in a lateral wellbore 110 extending from a main wellbore 112 includes: moving, arrow I, the wellbore liner into the lateral wellbore through a window 114 in the main wellbore casing 115; biasing, arrow P, the wellbore liner into a position toward an upper end 114*b* of the window; and securing the wellbore liner in the position. Securing can be via the bias force or through extra means such as a cementing.

The method may incorporate an action of increasing the bias of the wellbore liner with increased axial movement of the liner into the lateral wellbore.

Biasing may include locating a biasing member such as a key 122 protruding from an outer surface of the liner 118 into the V-shaped downhole end 114*a* of the window. The key 122 can both find the lower V in the window and engage into it. Then key 122 exerts a diametrically directed force away from the key to push the liner away from the location of the key. Generally, the key may be configured to push the liner uphole away from the V-shaped downhole end 114*a*. In such an embodiment, the method may further comprise limiting travel of the key further into the lateral wellbore; and converting continued movement of the lateral liner into the lateral wellbore into a biasing force to bias the lateral liner away from the key.

The method can include cementing between the lateral liner and the lateral wellbore wall, if desired. Cementing can be conducted while the biasing force, arrows P, is maintained.

The lateral liner can include a lateral transition joint 130 at its upper end. The lateral transition joint is partially or fully removed after the liner is in position. In FIG. 10, the biasing member 122 is coupled to the lower end of transition joint 130. In one embodiment, the method includes removing any portion of the lateral liner, for example, transition joint 130, that protrudes into the main wellbore 112. The removal can for example be by milling. The biasing member can remain in place after removal of the protruding portion, or it can be partially or fully removed.

The lateral liner is therefore retained in the lateral wellbore and does not create a catch point for reentry to the main or lateral wellbores. In one embodiment, the lateral liner can be run in with or without a whipstock.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A liner junction placement device for positioning a lateral liner in a lateral wellbore accessed through a window having a V-shaped downhole end, the liner junction placement device comprising:

a lateral liner biasing member carried on (i) the lateral liner outer surface or (ii) a lateral liner run-in tool, the lateral liner biasing member being configured to be positioned between the lateral liner and the lateral wellbore at the window and configured to urge the lateral liner away from one side of the lateral wellbore.

2. The liner junction placement device of claim 1, wherein the lateral liner biasing member is configured to increase the bias away from one side of the lateral wellbore as the lateral liner is moved further into the lateral wellbore.

3. The liner junction placement device of claim 2, wherein the lateral liner biasing member includes a key protruding from the lateral liner configured for locating the V-shaped downhole end of the window.

4. The liner junction placement device of claim 3, further comprising a linkage configured to rotate out away from the lateral liner when the key locates the V-shaped downhole end of the window.

5. A method for placing a wellbore liner in a lateral wellbore extending from a main wellbore, the method comprising:

moving the wellbore liner into the lateral wellbore through a window in the main wellbore;

positioning a key coupled to the wellbore liner to bear against the lateral wellbore wall;

biasing the wellbore liner by operation of the key into a position toward an upper end of the window; and securing the wellbore liner in the position.

6. The method of claim 5 wherein biasing the wellbore liner includes increasing the bias of the wellbore liner with increased axial movement of the wellbore liner into the lateral wellbore.

7. The method of claim 5 wherein biasing includes locating the key protruding from an uphole end of the wellbore liner into a V-shaped downhole end of the window.

8. The method of claim 7 further comprising:

limiting travel of the key further into the lateral wellbore; and converting continued movement of the lateral liner into the lateral wellbore into a biasing force to bias the lateral liner away from the key.

* * * * *